United States Patent [19]

Esser

[11] Patent Number: 4,557,544

[45] Date of Patent: Dec. 10, 1985

[54] TERMINAL FOR CONNECTING A LEAD WIRE TO A COIL WIRE

[75] Inventor: Wilhelm C. J. Esser, Tilburg, Netherlands

[73] Assignee: AMP Incorporated, Harrisburg, Pa.

[21] Appl. No.: 682,469

[22] Filed: Dec. 17, 1984

[51] Int. Cl.[4] ..... H01R 4/24

[52] U.S. Cl. ..... 339/97 R; 339/95 D

[58] Field of Search ..... 339/95 D, 97 R, 97 P, 339/98, 99 R

[56] References Cited

U.S. PATENT DOCUMENTS 4,036,545 7/1977 Mysiak ..... 339/97 R 4,130,331 12/1978 Neff et al. ..... 339/97 R

*Primary Examiner*—Joseph H. McGlynn

*Attorney, Agent, or Firm*—Frederick W. Raring

[57] ABSTRACT

Electrical terminal for connecting a lead wire to a varnish insulated wire extending from a coil comprises first and second plate-like members in aligned spaced-apart relationship. The plate-like members are connected by spaced-apart straps extending between corresponding ends of the members and aligned slots extend inwardly from the ends so that a coil wire can be moved relatively between the straps and into the slots. A pair of stabilizing ears extend from the side edges of one of the plate-like members towards and past the side edges of the other plate-like member thereby to strengthen and stabilize the box-like structure. A connecting member is provided for connecting a lead wire to the terminal. This connecting member may comprise a tab or lance extending from one of the ears transversely across the entire width of the box-like structure towards the other ear so that a wire can be inserted between the end of the tab and the interior surface of the ear.

8 Claims, 10 Drawing Figures

TERMINAL FOR CONNECTING A LEAD WIRE TO A COIL WIRE

FIELD OF THE INVENTION

This invention relates to electrical terminals for connecting lead wires to relatively fine wires extending from an induction coil or the like and is particularly directed to a terminal having improved strength and which is resistant to damage during normal handling.

BACKGROUND OF THE INVENTION

A commonly used type of electrical terminal for connecting a wire extending from a coil to a lead wire comprises a pair of plate-like members in aligned parallel spaced-apart relationship which are connected at corresponding ends by a pair of strap members. Aligned wire-receiving slots are provided in the plate-like members so that the coil wire can be moved laterally of its axis between the connecting straps and into the wire-receiving slots. A connecting member is provided for making the electrical connection to the lead wire and may be of several different forms. In one type of terminal, the connecting member comprises a tab which extends from one of the plate-like members towards the other plate-like member so that the wire can be inserted between the plate-like members until it is lodged between the end of the tab and the interior surface of the other plate-like member.

Terminals of the type described above are produced in continuous strip form with each terminal being integral with a carrier strip so that the strip can be fed to an automatic machine which severs the terminals from the strip and inserts them into housings on a coil or the like to form the electrical connection of the coil wire. FIG. 2 of U.S. Pat. No. 3,984,908 shows a strip of terminals of this type and illustrates the manner in which they are inserted into cavities in a housing to form electrical connections with a lead wire from a coil of a motor stator.

The known types of terminals as described above are highly satisfactory from an electrical standpoint and are being used in large numbers by manufacturers of small motors, coils, and devices incorporating coils. It would be desirable, however, to provide a terminal having improved strength for certain applications in order to prevent damage to the terminal during normal handling prior to the terminals being inserted into a housing and during such manufacturing operations as electroplating. The present invention is directed to the achievement of a terminal which will satisfy these requirements.

THE INVENTION

The invention comprises a strip of electrical terminals, each of the terminals being of the type comprising a pair of plate-like members in aligned spaced-apart relationship. Each of the plate-like members has a first end, a second end, and side edges extending between the ends. The first ends are connected to each other by spaced-apart connecting straps and each of the plate-like members has a wire-receiving slot extending inwardly from its first end for the reception of a first wire, particularly, a wire extending from a coil or the like. An additional connecting member is provided for connecting a second wire such as a lead wire to the terminals. The terminals are connected to each other in side by side relationship and are characterized in that one of the plate like members has a pair of stabilizing ears extending fom its side edges towards the other plate-like member. The stabilizing ears have free ends which are located beyond the side edges of the other plate-like member so that each of the plate-like members is stabilized against movement in its on plane relative to the other plate-like member.

In accordance with further embodiments, the stabilizing ears are integral with the side edges of the second plate-like member and extend towards, and past, the side edges of the first plate-like member. The terminals of the strip may be connected to each other by connecting sections which are integral with, and extend between, the side edges of the first plate-like members of adjacent terminals in the strip.

In accordance with further embodiments, the connecting member for the lead wire comprises a wire retaining lance or tab which extends from one of the ears towards the other ear and which is between the plate-like members. The retaining lance is in a plane which extends perpendicularly of the plate-like members and has a free end which is proximate to the interior surface of the other ear whereby the wire can be inserted to a position between the free end of the other ear and the second wire or lead wire will be offset laterally from the first wire or coil wire which is in the wire-receiving slots.

THE DRAWING FIGURES

Figure 2:
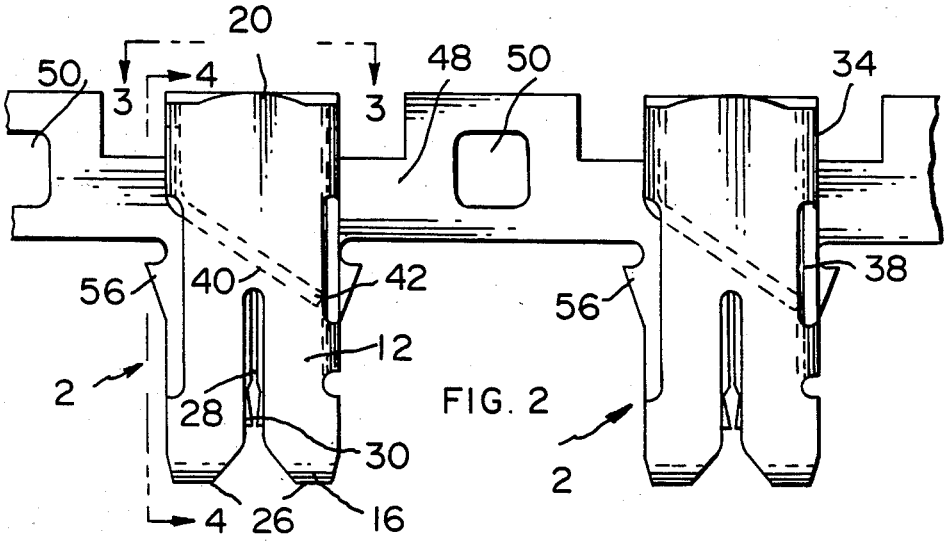
FIG. 2 is a frontal view of the terminal of FIG. 1.
Figure 3:
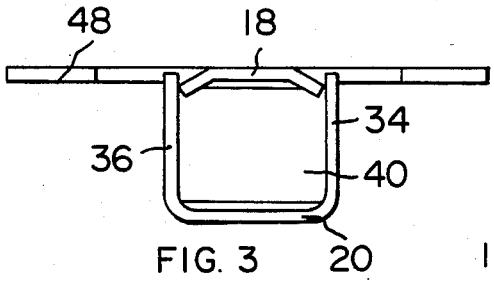
Figure 4:
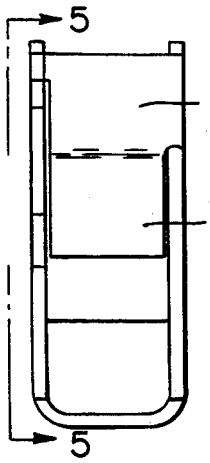

FIGS. 3 and 4 are views looking in the direction of the arrows 3—3 and 4—4 of FIG. 2.

Figure 5:
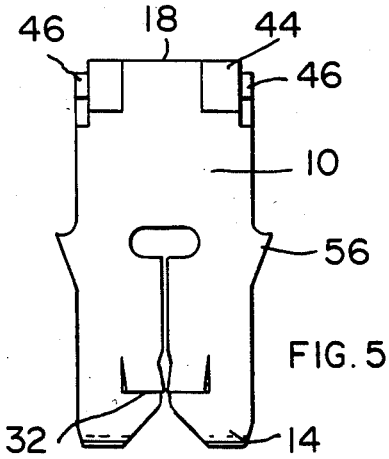

FIG. 5 is a view looking in the direction of the arrows 5—5 of FIG. 4.

Figure 1:
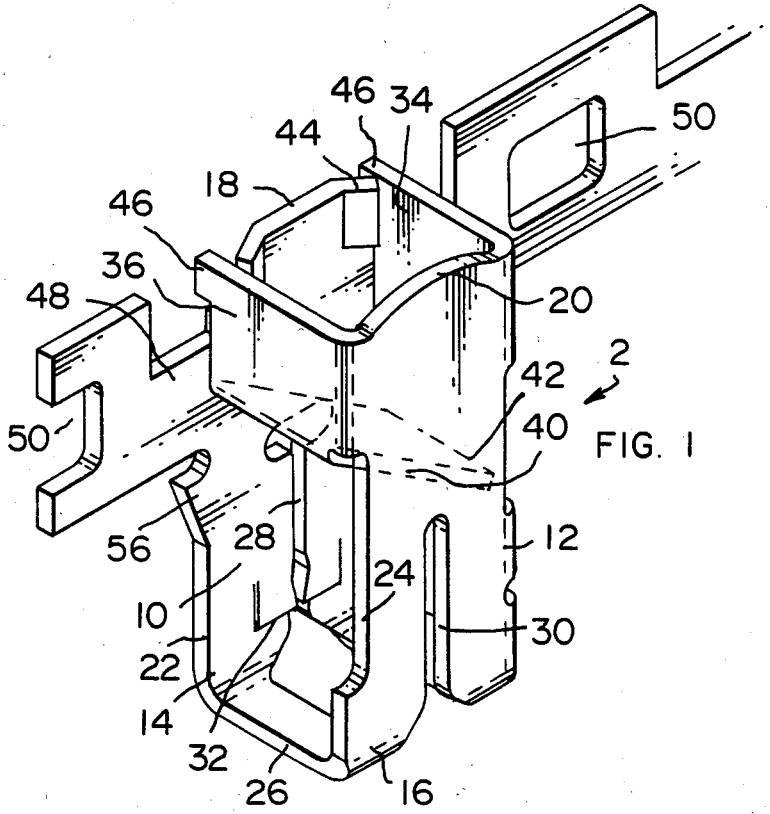
FIG. 1 is a perspective view of a terminal in accordance with the invention showing a portion of the strip to which the terminal is attached.
Figure 6:
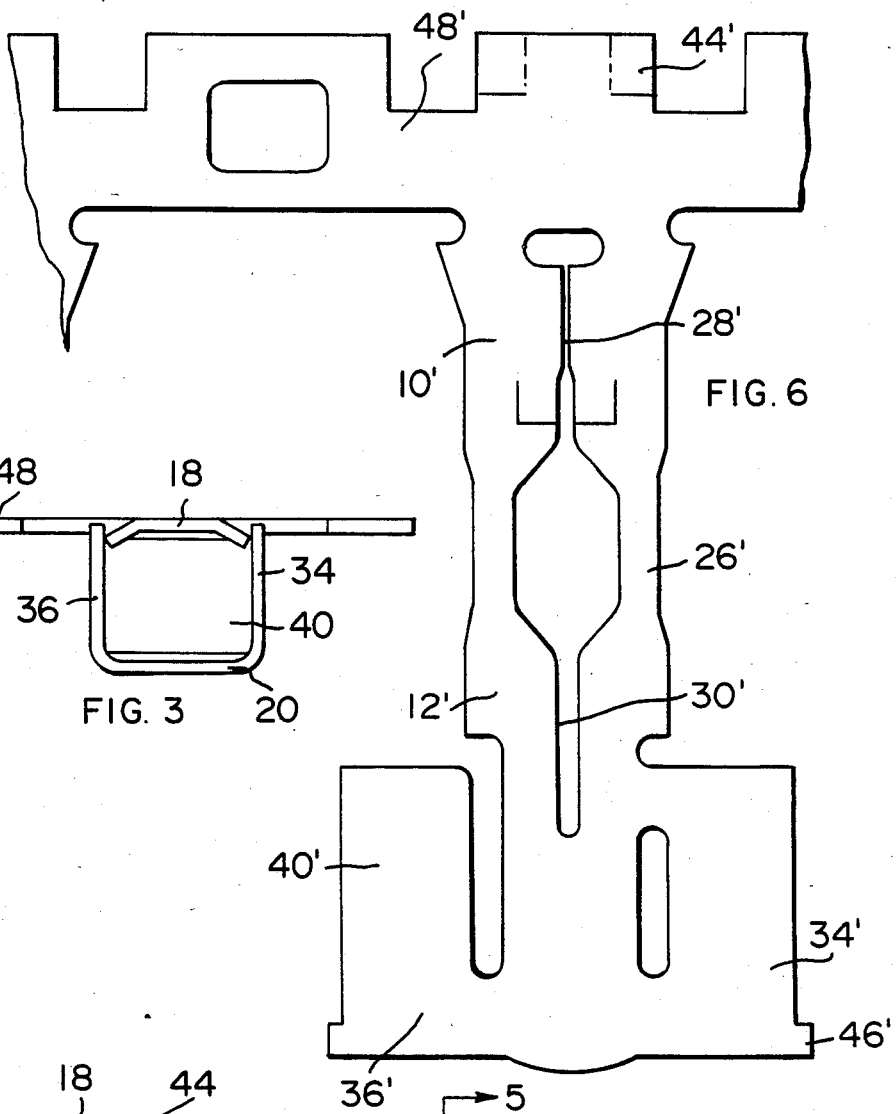

FIG. 6 is a plan view of the flat stamped blank from which the terminal of FIG. 1 is produced by bending and forming operations in a stamping and forming die.

Figures 7, 8, 9, 10:
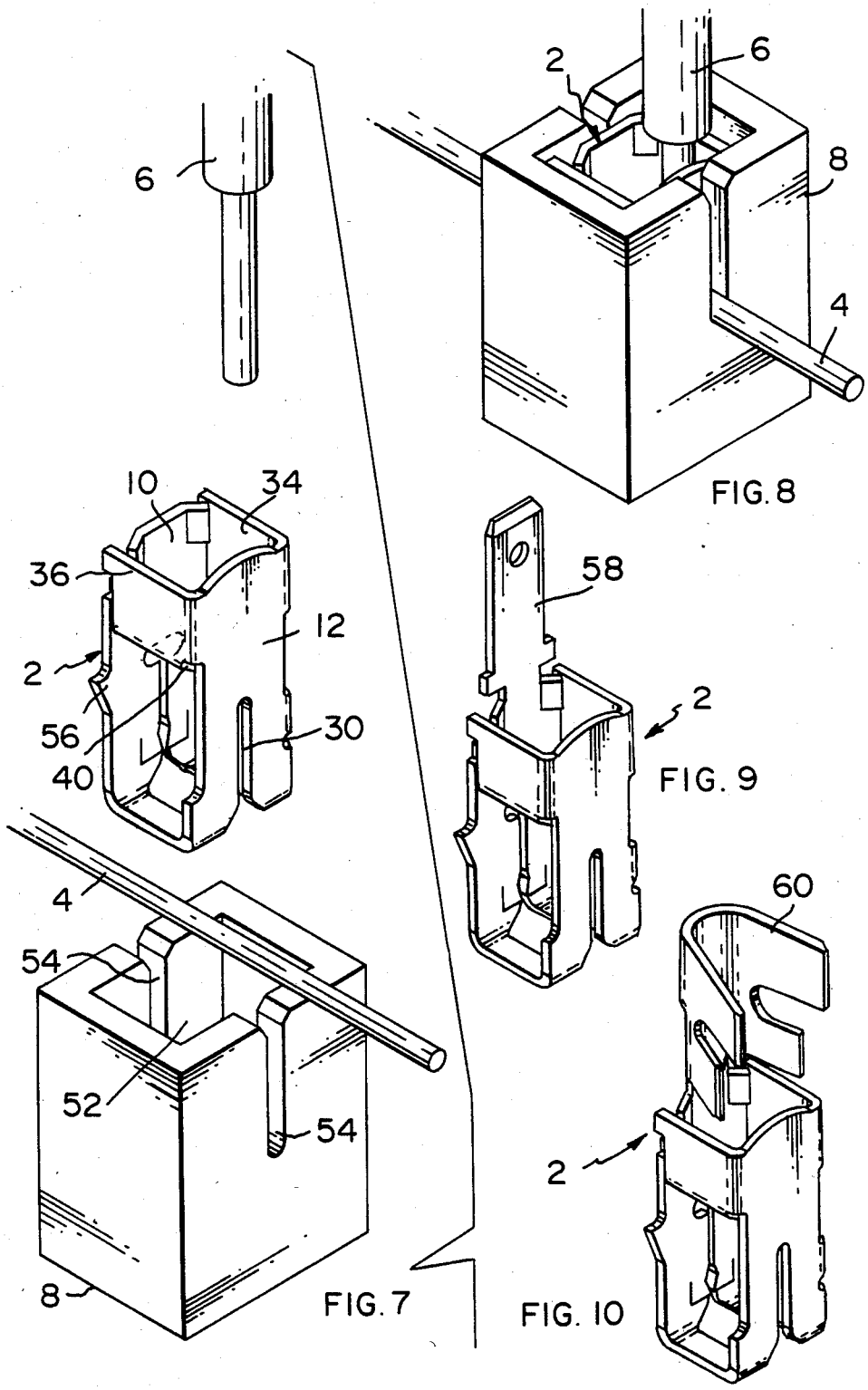

FIG. 7 is a perspective view showing portions of a terminal housing and a terminal in accordance with the invention exploded from the housing cavity with the coil wire and the lead wire in alignment with a terminal.

FIG. 8 is a perspective view similar to FIG. 7 but showing the terminal as inserted into the cavity and the wires connected to the terminal.

FIGS. 9 and 10 are perspective views showing alternative embodiments of terminals in accordance with the invention.

THE DISCLOSED EMBODIMENT

As shown in FIGS. 7 and 8, a terminal 2 in accordance with the invention is dimensioned to be inserted into a cavity in an insulating housing 8 and to connect a first wire 4 to a second wire 6. The first wire 4 will usually be a relatively fine wire which extends from a coil and which has a film type insulation on its surface. The second wire 6 may be a conventionally insulated wire. The manner of connecting the terminal to the wire 4, 6 will be described below.

Referring now to FIGS. 1–6, the terminal 2 comprises first and second generally rectangular plate-like members 10, 12 which are in aligned, spaced-apart relationship. The first and second plate-like members have lower or first ends 14, 16 and second ends 18, 20 which are the upper ends in the drawing. The plate-like members have side edges 22, 24 which extend between their ends and the first ends 14, 16 are connected to each other by spaced-apart connecting straps 26. Wire receiving slots 28, 30 extend inwardly in the first and second plate-like members from the lower or first ends so that a coil wire can be moved laterally of its axis, between the connecting straps 26 and into the wire-receiving slots. In the embodiment shown, the slot 28 in the first plate-like member has a width which is less than the diameter of the wire 4 so that the insulation of the coil wire will be penetrated and electrical contact will be established. The slot 30 has a width greater than the diameter of the wire 4 and is provided for clearance purposes although this slot can also be a wire-contacting slot if desired. As shown in FIG. 5, portions of the first plate-like member are sheared along L-shaped shear lines 32 on each side of the slot 28 and the sheared portion bent inwardly from the plane of the plate-like member and then back into the plane of the plate-like member to provide extremely small shoulders in the slot 28. These shoulders are necessary to penetrate the tough film insulation on the coil wire.

Stabilizing ears 34, 36 extend fom the side edges 24 of the second plate-like member 12 towards the first plate-like member. The ear 34 extends from the upper end 20 of the plate-like member 12 a substantial distance towards the lower end of the terminal and because of the length of this ear, a narrow opening 38 may be provided to facilitate bending of the ear relative to the plate-like member 12. The ear 36 extends from the upper end 20 of the plate-like member 12 only partially along the side edge and has an integral wire retaining lance or tab 40 extending therefrom. As best shown in FIG. 2, this lance or tab extends diagonally between the plate-like members and has a free end 42 which is substantially against the interior surface of the ear 34. While the free end 42 is below the enter end of the wire-receiving slots 28, 30 as shown in FIG. 2, the intermediate portion of the tab 40 is above these slots so that the tab will not engage or interfere with a coil wire positioned in the wire-receiving slots.

The first plate-like member 10 has side portions 44, FIG. 3, which are inwardly bent towards the second plate member as shown so that the outer or free ends 46 of the ears 34, 36 extend beyond these inwardly bent portions. As a result, the terminal in its finished form comprises a box-like structure which is relatively rigid in that the plate-like members 10, 12 are prevented from moving in their own planes relative to each other; the interior surfaces of the ears will engage the edges of the first plate-like member and prevent movement in either direction along the length of the strip of the second member 12. Similarly, the first plate-like member is stabilized by the ears so that the finished terminal is relatively strong and is resistant to damage during normal handling.

In the embodiment shown, the adjacent terminals in the strip are connected to each other by connecting sections 48 which extend between the side edges 22 of adjacent terminals. Pilot holes 50 are provided to facilitate feeding of the strip to an insertion machine when the terminal is inserted into a housing. FIG. 6 shows the flat blank from which the terminal is produced. The parts of the blank are identified by the same reference numerals, differentiated by prime marks, as those used in describing the terminal.

As shown in FIGS. 7 and 8, the housing will normally be provided on a coil bobbin or it may be provided on a plastic part fitted onto a coil stator. In any event, the housing will have a cavity 52 as shown which is dimensioned to receive the terminal and the terminal has barbs 56 which retain it in the cavity after insertion. The housing has aligned relatively wide wire admitting slots 54 for the coil wire. In use, the coil wire is positioned in the slots 54 and the terminal is inserted as indicated in FIG. 7 into the cavity. The cavity has a support for the coil wire at its inner end so that the coil wire moves relatively into the wire receiving slots of the terminal as the terminal is inserted. Thereafter, the wire 6 can be connected to the terminal by simply moving it into the open upper end of the terminal. The end of the wire will be guided by the inclined tab 40 towards the free end 42 of the tab and after the wire is pushed beyond the free end, it will be engaged by the tab and pressed against the interior surface of the ear 34.

FIGS. 9 and 10 show alternative embodiments of the invention having different connecting means for the lead wire 6. FIG. 9 shows a version in which a tab 58 extends from the first plate-like member which tab is dimensioned to be connected to a disconnect-type receptacle. FIG. 10 shows a version in which a U-shaped crimped barrel 60 is provided so that the second wire can be connected by crimping to the terminal. It should be mentioned that a relatively narrow tab can also be inserted into the terminals shown FIGS. 1–6 provided the width of the tab is less than the distance between the interior surfaces of the opposed plate-like members 10, 12.

It will be apparent from the foregoing description that a terminal in accordance with the invention is extremely robust as compared with known similar types of terminals and is able to withstand abusive handling during electroplating or other handling operations prior to its being put to use. Also, and particularly with respect to the embodiment shown in FIG. 1, the lead wire is guided to the side of the terminal when it is inserted into the terminal and there is no possibility that the lead wire will in any way disturb the relatively delicate coil wire which is already connected to the terminal.

I claim:

1. A strip of electrical terminals, each of the terminals being of the type comprising a pair of plate-like members in aligned spaced-apart relationship, each of the plate-like members having a first end, a second end, and side edges extending between the ends, the first ends being connected to each other by spaced-apart connecting straps, each of the members having a wire-receiving slot extending inwardly from its first end for reception of a first wire, a connecting member on the terminal for connecting a second wire to the terminal, the terminals being connected to each other in side-by-side relationship, the strip of terminals being characterized in that:

one of the plate-like members has a pair of stabilizing ears extending from its side edges towards the other plate-like member, the stabilizing ears having free ends which are located beyond the side edges of the other plate-like member whereby each of the plate-like members is stabilized against movement in its own plane relative to the other plate-like member.

2. A strip of electric terminals as set forth in claim 1 characterized in that the wire-receiving slot in one of the plate-like members is an electrical contact slot having a width which is less than the diameter of the first wire, the wire-receiving slot in the other plate-like member having a width which is greater than the diameter of the first wire and being a clearance slot.

3. A strip of electrical terminals as set forth in claim 1 characterized in that the stabilizing ears are integral with the side edges of the second plate-like member and extend towards and past the side edges of the first plate-like member.

4. A strip of electrical terminals as set forth in claim 3 characterized in that the terminals of the strip are connected to each other by connecting sections which extend between the side edges of the first plate-like members of adjacent terminals in the strip.

5. A strip of electrical terminals as set forth in either of claims 1 or 4 characterized in that the connecting member on the terminal comprises a wire-retaining lance which extends from one of the ears towards the other ear, the retaining lance being between the first and second plate-like members and being in a plane which extends perpendicularly of the plate-like members, the lance having a free end which is proximate to the other ear whereby the second wire can be inserted to a position between the free end and the other ear.

6. A strip of electrical terminals as set forth in either of claims 1 or 4 characterized in that the connecting member extends from one of the plate-like members.

7. A strip of electrical terminals as set forth in claim 6 characterized in that the connecting member comprises a connecting tab.

8. A strip of electrical terminals as set forth in claim 6 characterized in that the connecting member is a crimpable ferrule.

* * * * *